US009598818B2

(12) United States Patent
Lööf et al.

(10) Patent No.: US 9,598,818 B2
(45) Date of Patent: Mar. 21, 2017

(54) APPARATUS FOR WASHING AND/OR DEWATERING OF CELLULOSE PULP

(71) Applicant: Valmet AB, Sundsvall (SE)

(72) Inventors: Tobias Lööf, Söråker (SE); Patrik Pettersson, Alnö (SE); Jonas Orgård, Stöde (SE); Hans Lövgren, Sundsvall (SE); Per Wallin, Alnö (SE); Peter Nykvist, Timrå (SE); Jonas Magnusson, Sundsvall (SE)

(73) Assignee: Valmet AB (SE)

( * ) Notice: Subject to any disclaimer, the term of this patent is extended or adjusted under 35 U.S.C. 154(b) by 0 days.

(21) Appl. No.: 14/650,781

(22) PCT Filed: Dec. 19, 2013

(86) PCT No.: PCT/SE2013/051570

§ 371 (c)(1),
(2) Date: Jun. 9, 2015

(87) PCT Pub. No.: WO2014/109693

PCT Pub. Date: Jul. 17, 2014

(65) Prior Publication Data

US 2015/0361617 A1 Dec. 17, 2015

(30) Foreign Application Priority Data

Jan. 11, 2013 (SE) ..... 1350030

(51) Int. Cl.
*D21F 1/66* (2006.01)
*D21C 9/06* (2006.01)
(Continued)

(52) U.S. Cl.
CPC ..... *D21F 1/66* (2013.01); *D21C 9/06* (2013.01); *D21C 9/18* (2013.01); *D21D 1/40* (2013.01); *D21F 1/74* (2013.01)

(58) Field of Classification Search
CPC ..... D21F 1/66; D21F 1/02
(Continued)

(56) References Cited

U.S. PATENT DOCUMENTS 3,980,518 A 9/1976 Ljung et al.
4,343,708 A 8/1982 Rantanen et al.
(Continued)

FOREIGN PATENT DOCUMENTS

EP 1229164 B1 4/2006
SE 516335 C2 12/2001
(Continued)

OTHER PUBLICATIONS

International Search Report for Application No. PCT/SE2013/051570 dated Feb. 25, 2014.

*Primary Examiner* — Mark Halpern
(74) *Attorney, Agent, or Firm* — Lerner, David, Littenberg, Krumholz & Mentlik, LLP

(57) ABSTRACT

Apparatus for washing and/or dewatering cellulose pulp is disclosed including a movable permeable surface in a pulp transportation chamber having a chamber gap above the movable permeable surface, a pulp distributor for distributing pulp onto the movable permeable surface, a throttle having a throttle gap width and an adjustable throttle adjuster to remotely adjust the throttle gap width so that a volume of pulp flow into the pulp distributor is equal to or greater than the volume of pulp flow out of the distributor during operation.

15 Claims, 7 Drawing Sheets

(51) Int. Cl.
*D21C 9/18* (2006.01)
*D21D 1/40* (2006.01)
*D21F 1/74* (2006.01)

(58) Field of Classification Search
USPC ..... 162/348
See application file for complete search history.

(56) References Cited

U.S. PATENT DOCUMENTS

| | | | | |
|---|---|---|---|---|
| 6,306,259 | B1 * | 10/2001 | Lamas | D21C 9/18 100/118 |
| 6,521,094 | B2 * | 2/2003 | Lamas | D21C 9/18 100/118 |
| 6,668,600 | B1 * | 12/2003 | Hansson | D21C 9/06 68/181 R |
| 8,105,464 | B2 * | 1/2012 | Danielsson | D21C 9/06 162/202 |
| 8,211,273 | B2 * | 7/2012 | Andersson | B30B 9/20 162/232 |
| 8,448,789 | B2 * | 5/2013 | Bylander | D21C 9/06 162/203 |
| 2009/0120602 | A1 * | 5/2009 | Lundberg | D21F 1/78 162/358.1 |

FOREIGN PATENT DOCUMENTS

| | | | |
|---|---|---|---|
| SE | 532366 | C2 | 12/2009 |
| WO | 8805840 | A1 | 8/1988 |
| WO | 2009075641 | A1 | 6/2009 |
| WO | 2009131527 | A1 | 10/2009 |

* cited by examiner

APPARATUS FOR WASHING AND/OR DEWATERING OF CELLULOSE PULP

CROSS-REFERENCE TO RELATED APPLICATIONS

The present application is a national phase entry under 35 U.S.C. §371 of International Application No. PCT/SE2013/051570 filed Dec. 19, 2013, published in English, which claims priority from Swedish Application No. 1350030-1 filed Jan. 11, 2013, all of which are hereby incorporated herein by reference.

FIELD OF THE INVENTION

The present invention relates to apparatus for washing and/or dewatering cellulose pulp.

BACKGROUND OF THE INVENTION

Pulp washing is a key operation in a pulping line. There are many different types of washing apparatuses available, some of which are based on press washing and comprise means for pressing the pulp to remove liquid. After pressing, the pulp can, if suitable, be diluted to a desired consistency.

A well-known washing apparatus is a twin-roll press of the general type disclosed in U.S. Pat. No. 3,980,518, for example. It has two counter-rotating rolls with perforated outer surfaces. A web of pulp is formed on the respective rolls and is transported in the direction of rotation in a vat partially surrounding the rolls, to the so-called press nip between the rolls. The liquid removed from the pulp, i.e. the filtrate, passes through the perforated roll surface in a radial inwards direction and is led to the ends of the press roll, where it is output. Washing liquid or other treatment liquid may be supplied to the pulp web through inlets in the vat. The twin-roll press uses the washing principles of displacement, where dirty liquid (liquor) in the pulp is replaced by cleaner wash liquid added to the vat, and pressing, where dirty liquid is pressed (squeezed) out from the pulp, in particular at the press nip.

The incoming pulp can be distributed lengthwise onto the respective press rolls by means of a distribution device, for example by using a rotating screw, such as the device shown in European Patent No. 1,229,164 B1, or the device shown in Swedish Patent No. 532,366 C2. There is a problem with the distribution of pulp along the total length of the press roll, with a danger that the end parts of the press rolls operate without pulp.

In Swedish Patent No. 516,335 a device is described for feeding cellulose pulp, in the form of a pulp web. In this device the outlet includes restrictions in the form of holes, which are arranged along the generator of the envelope surface of the inlet box. The holes are preferably arranged so that their diameter is smaller than the distance between them. In that way, the pressure is maintained in the inlet box such that the pulp is forced out of the outlet and is uniformly distributed along the width of the pulp web. The holes have, however, a tendency to plug.

SUMMARY OF THE INVENTION

An object of the present invention is to provide an improved pulp distribution device for an apparatus for washing and/or dewatering of cellulose pulp that solves the problem in the prior art.

Some of the advantages of this invention are that the pulp distribution device will operate more filled than in earlier solutions. This leads to a better forming of the pulp web along the press roll are also in the ends of the press roll, independent of the rotation of speed of the press roll. This gives a higher capacity of the washing apparatus and a better washing. The formation of the pulp web will also be smoother, since the pulp is not torn from the pulp distribution device.

These and other objects and advantages of the present invention may now be realized by the discovery of apparatus for washing and/or dewatering cellulose pulp comprising a first movable permeable surface traveling in a first direction, a pulp transportation chamber wall adjacent to the first movable permeable surface, sized to provide a pulp transportation chamber having a chamber gap between the pulp transportation chamber wall and the first movable permeable surface, the pulp distribution member comprising an inlet and an outlet arranged for distributing the pulp through the outlet onto the movable permeable surface, a throttle adjacent to the outlet of the pulp distribution member in the first direction, the throttle having a throttle gap width, a portion of the first movable permeable surface adjacent to the outlet of the pulp distribution member comprising a second permeable surface for initially dewatering the pulp moving in the first direction before the throttle, the second permeable surface being sufficiently large so as to begin forming and dewatering the pulp before the throttle, and an adjustable throttle member for remotely adjusting the throttle gap width, the throttle gap width being adapted whereby the pulp volume flow into the pulp distribution member is equal to or greater than the pulp volume flow out of the pulp distribution member during operation. Preferably, the pulp distribution member include web means for forming the pulp into a pulp web on the first movable permeable surface.

In accordance with one embodiment of the apparatus of the present invention, the throttle gap width is adapted so that the pump distribution member remains substantially full during operation.

In accordance with another embodiment of the apparatus of the present invention, the throttle gap width is adapted so that an internal pressure is created inside the pulp distribution member during operation.

In accordance with another embodiment of the apparatus of the present invention, the pulp transportation chamber wall includes the movable throttle device for adjusting the throttle gap width. Preferably, the movable throttle device comprises at least one longitudinal segment. In another embodiment, the movable throttle device comprises a flexible or pivotable plate. In another embodiment, the movable throttle device includes a clearance after the throttle in the first direction. Preferably, the apparatus includes moving means for moving the movable throttle device. In a preferred embodiment, the moving means is at least one rod, at least one plate, and/or at least one eccentric puck disposed on a shaft.

In accordance with another embodiment of the apparatus of the present invention, the throttle gap width may be fixed during operation, and may be set by selecting an exchangeable member. Preferably, the exchangeable member comprises a predetermined number of shims.

In accordance with another embodiment of the apparatus of the present invention, the apparatus includes automatic control means for controlling the throttle gap width based upon at least one parameter. Preferably, the at least one parameter is one of the following: the filling level of the pulp distribution member, the pressure in the pulp distribution member, the ratio between the pulp volume flow into the pulp distribution chamber, and the pulp volume flow out of the pulp distribution chamber, the temperature in the pulp distribution member, the pressure in the pulp distribution chamber, and the pulp level in the ends of the first permeable surface.

In accordance with another embodiment of the apparatus of the present invention, the first movable permeable surface comprises a first rotatable permeable surface of a press roll.

BRIEF DESCRIPTION OF THE DRAWINGS

The invention, together with further objects and advantages thereof, may best be understood by reference to the following description and appended drawings, in which.

DETAILED DESCRIPTION

Figure 1:
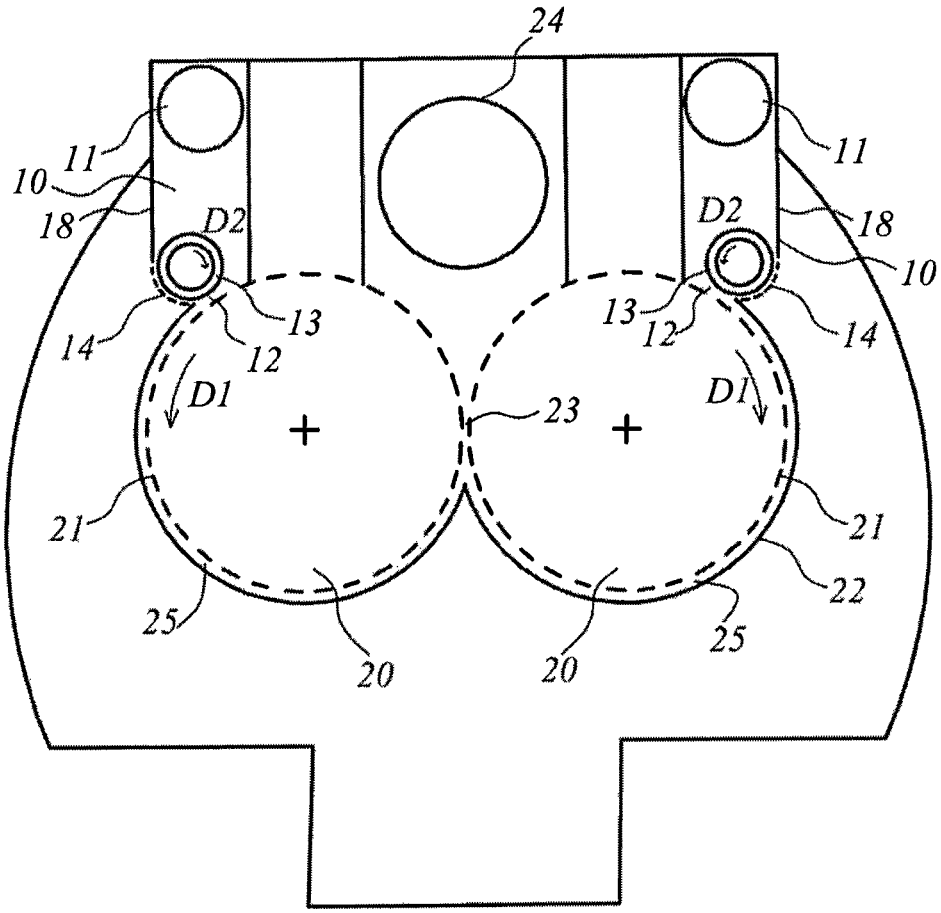
FIG. 1 is a schematic cross-sectional view illustrating a twin-roll press with pulp distribution devices according to an exemplifying embodiment of the invention.

In the drawings, similar or corresponding elements are denoted by the same reference numbers.

FIG. 1 illustrates an apparatus 100 for the washing and/or dewatering of cellulose pulp. The apparatus 100 is in this example in the form of a twin-roll press 100. The apparatus 100 comprises two co-operating cylindrical press rolls 20. The two press rolls 20 are arranged to rotate in opposite directions during operation (as indicated by the arrows) and each has a first rotatable permeable surface 21, more specifically a perforated metal sheet or the like. The press rolls 20 are partially enclosed by a vat 22 (also known as a trough) in the circumferential direction. The vat 22 comprises a vat wall 22 formed by guide surfaces and a vat chamber 25.

A pulp distribution device 10 is associated with each press roll 20. The pulp distribution device 10 is arranged at the upper portion of the press roll 20 for distribution of pulp onto the perforated roll surface 21. The pulp distribution device 10 comprises an elongated housing 18, extending lengthwise along the press roll 20. The pulp distribution device 10 is attached to the vat 22. During operation, pulp enters the pulp distribution device 10 via its inlet 11, which for example can be arranged at the middle of the twin-roll press 100 as seen in the longitudinal direction. The input consistency of the pulp is preferably in the range of 2-13%.

In the pulp distribution device 10, the pulp is distributed in the longitudinal direction and output through the outlet 12 during formation and dewatering of a pulp web on the first rotatable permeable surface 21 of the press roll 20.

A pulp transportation chamber 25 is defined as the chamber in which the pulp is transported in a pulp transportation direction, guided by a pulp transportation chamber wall 22 e.g. in the direction of rotation D1 to be pressed in a nip (also known as pinch) 23, where the distance between the press rolls 20 is smallest. In the example in FIG. 1, the pulp transportation chamber 25 is the same as the vat chamber 25, but the pulp transportation chamber may also include e.g. a pre-forming zone between the pulp distribution device 10 and the vat 22. Also the last part of the pulp distribution device 10 may in certain circumstances be considered to be included in the pulp transportation chamber. The pulp transportation chamber 25 has a chamber gap width Wv between the pulp transportation wall 22 and the first permeable surface 21 of the respective press roll 20.

Washing liquid may e.g. be supplied to the pulp web in the vat 22. The pulp is output by means of a discharge screw 24.

In FIG. 1, two press rolls 20, each provided with a pulp distribution device 10, are arranged next to each other, with the rotation centers in the same horizontal plane. The invention is also suitable for washing and/or dewatering apparatuses where, for example, the rolls are differently arranged, or only one perforated roll is used, as well as for another apparatus where pulp is dewatered on a first movable permeable surface, which is movable in other ways than by being rotatable.

The vat 22 may be formed by one continuous vat structure as in FIG. 1 or, alternatively, may comprise a number of vat segments linked together (not shown, a number of variants are known, compare e.g. International Application No. WO 2009/075641). In the latter case, one or more vat segments may be movable to and from the press roll 20, for example so as to facilitate cleaning of the press roll. There could, for example, be one movable vat segment extending into each pulp distribution device 10, e.g. pivotally attached at one of its ends.

Figure 2:
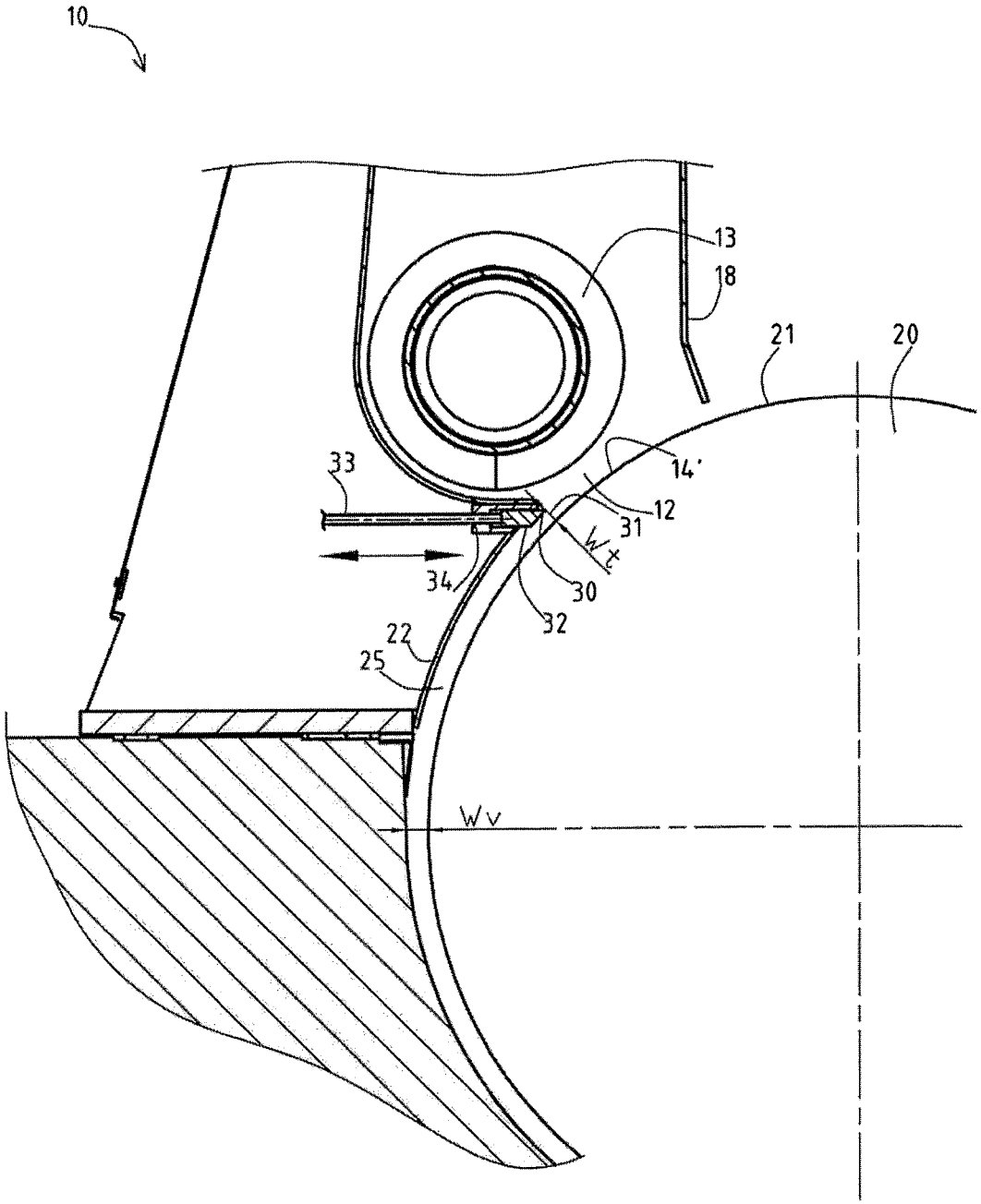
FIG. 2 is a schematic cross-sectional view illustrating a pulp distribution device in a washing apparatus (partially shown) according to a first embodiment of the invention.

FIG. 2 is a schematic cross-sectional view illustrating in more detail a pulp distribution device 10 according to an exemplifying embodiment of the invention. The pulp distribution device 10 is arranged in the apparatus 100, the upper left side of which is shown, so as to distribute pulp onto the first movable permeable surface 21 of the press roll 20, via the outlet 12. The pulp distribution device 10 may be of a type similar to e.g. the one described in Swedish Patent No. 532,366 C2 and preferably comprises an elongated housing 18 with a rotatable screw 13 or other rotatable distribution means 13 inside, rotating in a direction of rotation D2. Especially when low concentrations are used, other stirring means are also possible to use instead of a rotatable distribution means. The pulp distribution device 10 extends along the entire length of the press roll 20 and the rotation axis of the rotatable distribution means 13 is parallel to the rotation axis of the press roll 20.

According to the present invention it has been realised that the pulp volume flow into the pulp distribution device 10 should be at least equal to, but preferably higher than the pulp volume flow out from the pulp distribution device 10. Since there has to be an equal mass flow of dry pulp into and out from the pulp distribution device 10, an initial dewatering should be made through a second permeable surface 14 before the main dewatering is made through the first permeable surface 21. This means that it is preferred that the pulp distribution device 10 operates completely filled and has an internal pressure in order to better distribute the pulp and form a better pulp web along the total length of the press roll 20, as well as in the ends of the press roll 20. The pressure in the pulp distribution device 10 may also give an enhanced initial dewatering.

One way of making the pulp distribution device 10 operating completely filled would be to decrease the rotational speed of the press roll 20, so that a desired ratio between the pulp volume flow into the pulp distribution device 10 and the pulp volume flow out from the pulp distribution device 10 is achieved. However, it might not be possible due to other parameters, such as vat pressure.

A preferred way is to have a local throttle 31 in the pulp transportation chamber 25 near the outlet 12 of the pulp distribution device 10, i.e. that the chamber gap width Wv is locally smaller in a throttle gap width Wt near the outlet 12 of the pulp distribution device 10.

This means that the throttle 31 may be positioned e.g. in the beginning of the vat, in the pre-forming zone, if any, or in the outlet 12 of the pulp distribution device 10. An example may be that the throttle gap width Wt is 30 mm, while the chamber gap width Wv in other places is 40 mm. Note, that this throttle construction is independent of the appearance of the chamber gap width Wv in the rest of the transportation chamber 22, which chamber gap width Wv in other places may be constant, diverging or converging from the pulp distribution device 10 to the nip 23.

The second permeable surface 14 is provided before the local throttle 31 as seen in the pulp transportation direction. As an example the second permeable surface 14 may be provided by having initial dewatering means already in the pulp distribution device 10 e.g. in the form of a permeable wall 14 in the casing 18 (see FIG. 1) or through a permeable surface (not shown) of the rotatable distribution means 13, or the like.

Another solution is to position the throttle 31, so that there is a dewatering segment 14' of the first permeable surface 21 at the outlet 12 of the pulp distribution device 10, which dewatering segment 14' works as a second permeable surface 14'. The dewatering segment 14' should be sufficiently large for forming and dewatering of pulp to start already before the throttle 31.

Since the first permeable surface 21 is moving, what is meant with the dewatering segment 14' is of course the segment of the first permeable surface 21 that at a particular moment is at the outlet 12 of the pulp distribution device 10—i.e. the actual segment is constantly changing, when the first permeable surface 21 is moving.

In general, the result is better the closer the throttle 31 is positioned to the outlet 12 of the pulp distribution device 10 due to the risk of plugging before the throttle 31 if the distance between the throttle 31 and the outlet 12 is too big, but the invention will work at least in the distance of 0-0.5 m from the outlet 12 of the pulp distribution device 10. In the embodiment where the second permeable surface 14' is considered to be a segment of the first permeable surface 21, there should of course be a balance between having a sufficiently large dewatering segment 14' and having the throttle 31 sufficiently close to the outlet 12 of the pulp distribution device 10.

The throttle gap width Wt may be fixed and the throttle 31 simply formed as an edge, wedge, knife or similar 30 in the transportation chamber wall 22. It is, however, preferable that the throttle gap width Wt is adjustable and even more preferable that the throttle gap width Wt is adjustable during operation.

A simple solution for the adjustment could be to choose an appropriate number of shims to set the position of said edge, wedge or knife 30. More advanced embodiments can be seen in FIGS. 2-6.

FIG. 2 discloses an embodiment, where the pulp distribution device 10 is provided with a separate throttle device 32. The edge 30 may e.g. be formed by a sealing. The position of the throttle device 32 may be adjusted from the outside with at least one rod 33 through a sealing lead-through 34. For simplicity, the edge 30 is preferably divided into a number of longitudinal segments of e.g. 1 m.

Figure 3:
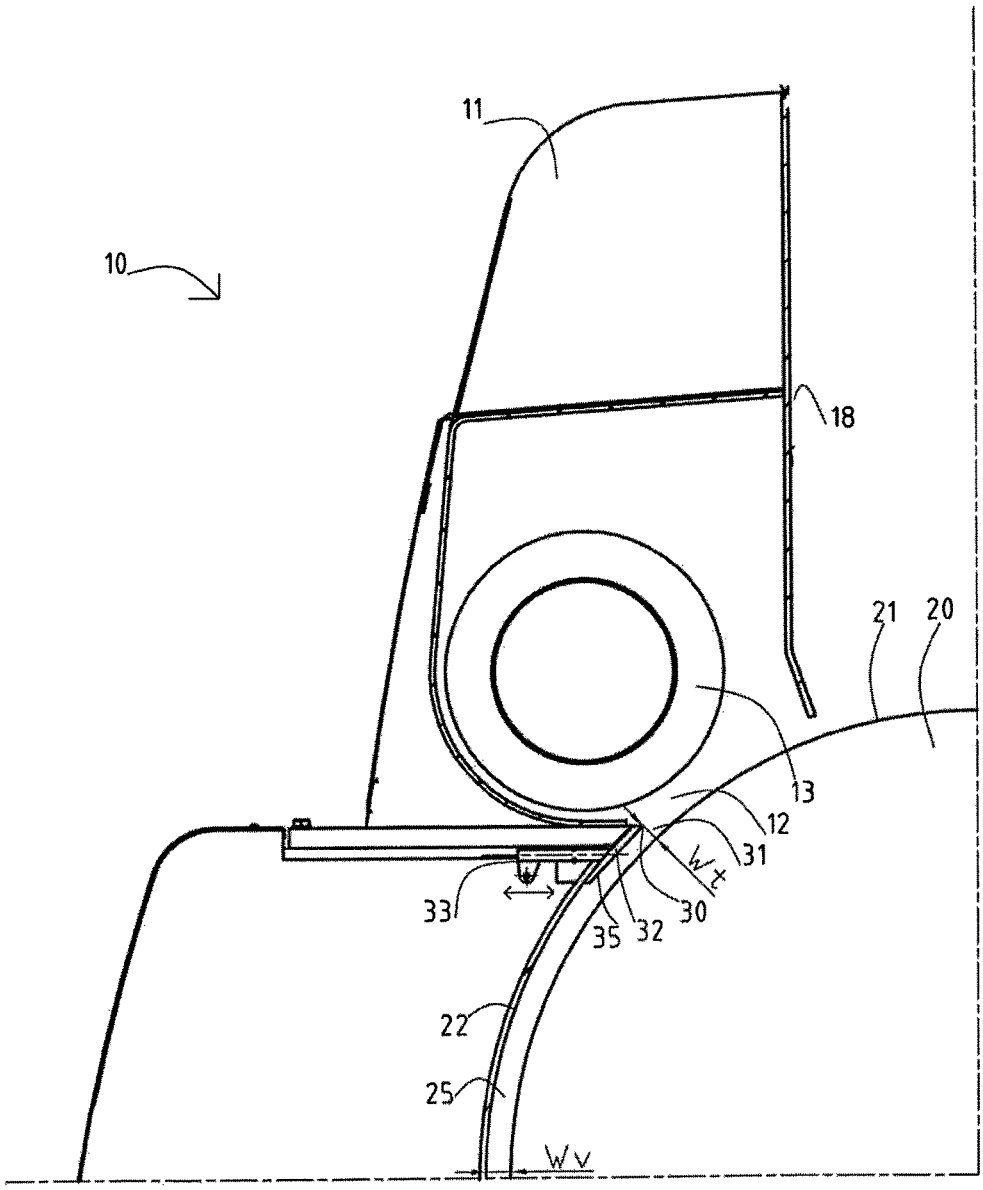
FIG. 3 is a schematic cross-sectional view illustrating a pulp distribution device in a washing apparatus (partially shown) according to a second embodiment of the invention.

In FIG. 3 is shown a longer variant of FIG. 2, where the edge 30 instead is formed by at least one plate, preferably divided into a number of longitudinal segments. The throttle device 32 is thus also provided with a clearance 35 after the throttle 31 in order to prevent plugging after the throttle device 32. The clearance angle is preferably 5-10°.

Figure 4:
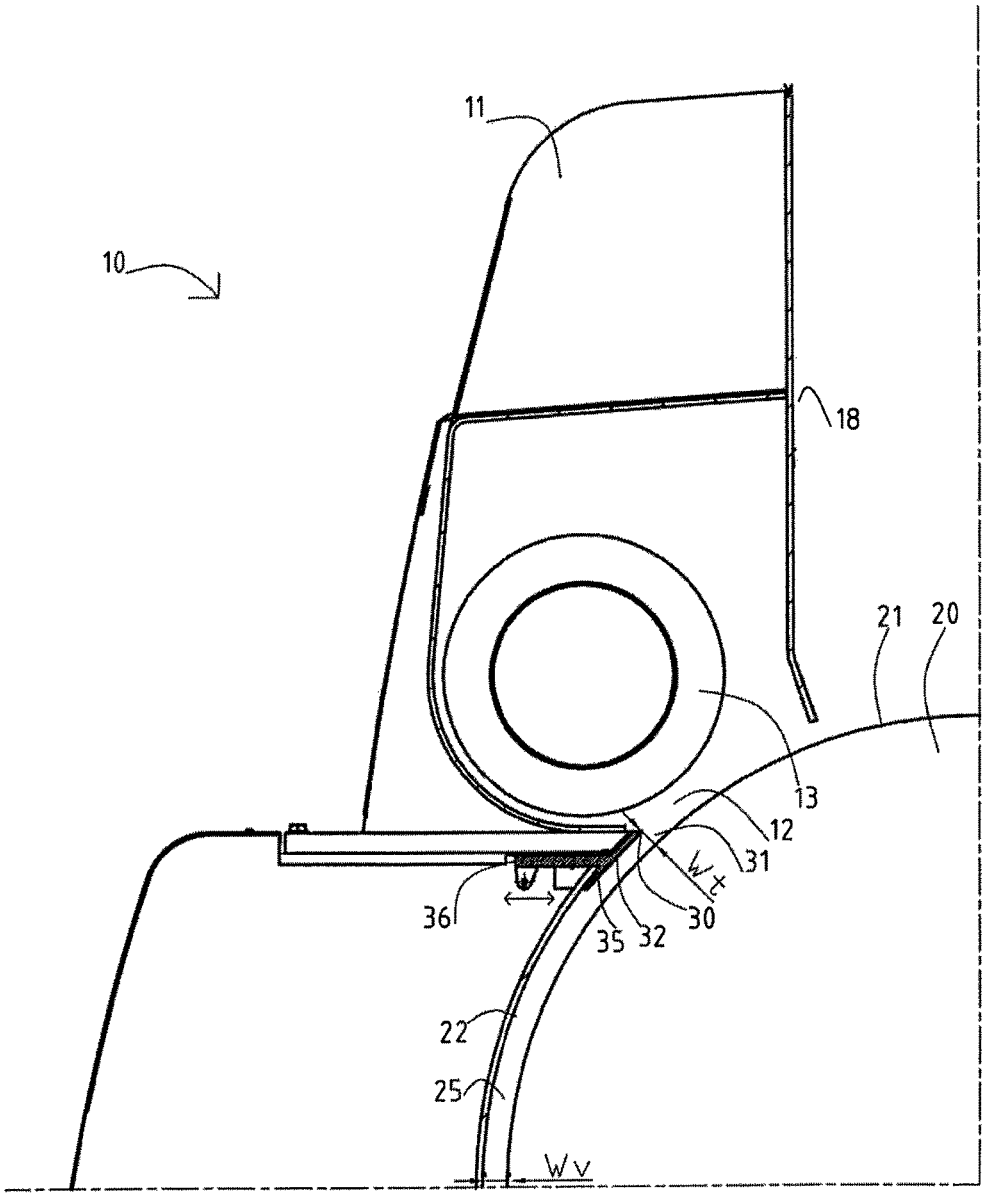
FIG. 4 is a schematic cross-sectional view illustrating a pulp distribution device in a washing apparatus (partially shown) according to a third embodiment of the invention.

FIG. 4 is a variant of FIG. 3, but where the throttle device 32 instead comprises two plates attached to each other, preferably also each divided into a number of longitudinal segments. The inner plate(s) 36 is/are instead of the rods 33.

Figure 5:
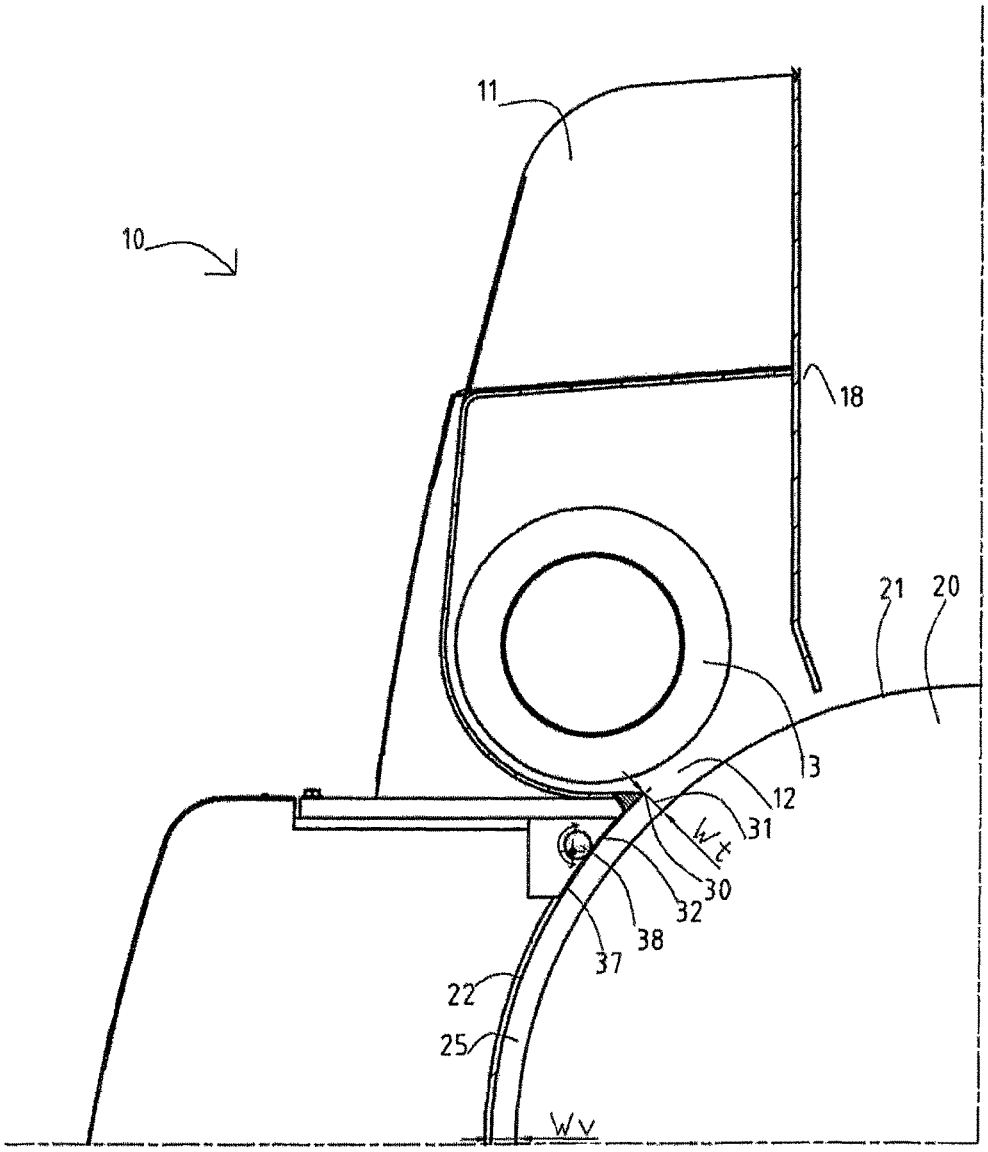
FIG. 5 is a schematic cross-sectional view illustrating a pulp distribution device in a washing apparatus (partially shown) according to a fourth embodiment of the invention.

In the FIGS. 2-4 the throttle device 32 was long, but comparatively small. In FIG. 5 is shown an embodiment where the throttle device 32 is somewhat larger. The part of the pulp transportation chamber wall 22 that is closest to the pulp distribution device 10 comprises at least one flexible plate 37 and a wedge 30. The position of the plate 37 may be adjusted by means of e.g. eccentric pucks 38 or similar. The pucks 38 are fixed to a shaft which goes through the apparatus 100. In this way adjustment of the throttle gap width Wt may be done e.g. by means of a not shown turning device on the side of the apparatus 100.

Figure 6:
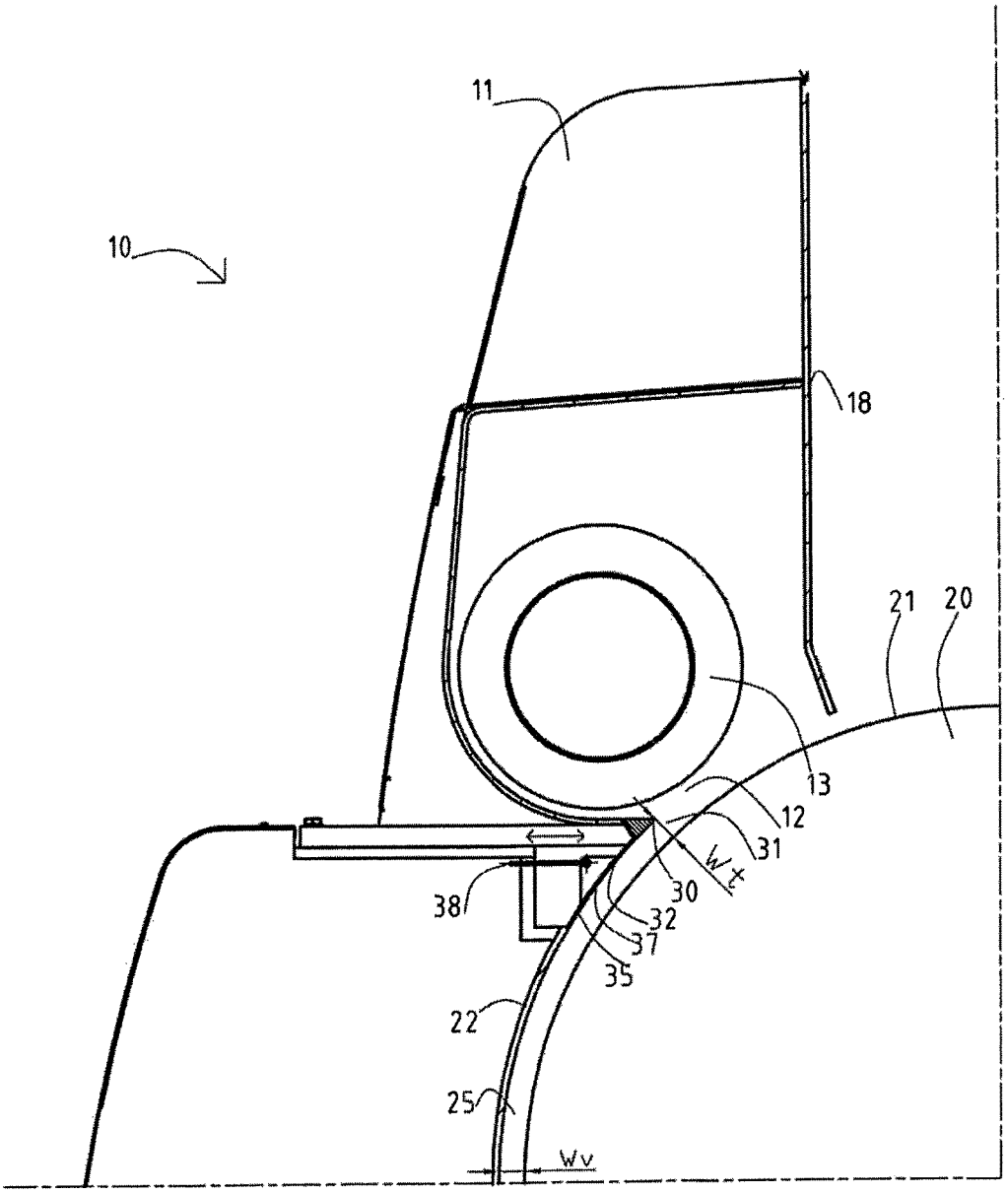
FIG. 6 is a schematic cross-sectional view illustrating a pulp distribution device in a washing apparatus (partially shown) according to a fifth embodiment of the invention.
Figure 7:
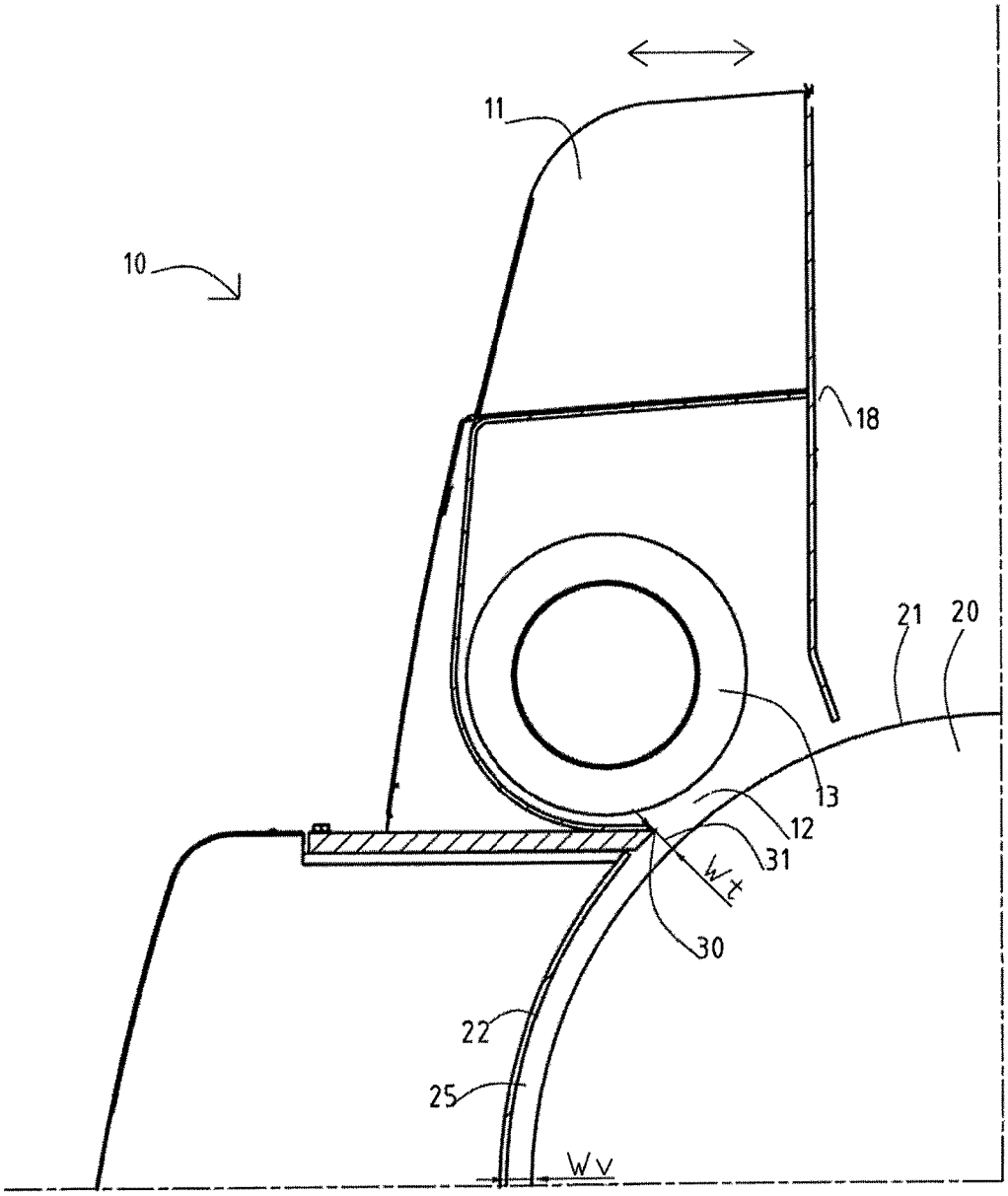
FIG. 7 is a schematic cross-sectional view illustrating a pulp distribution device in a washing apparatus (partially shown) according to a sixth embodiment of the invention.

In FIG. 6 is shown another variant of FIG. 5. In this embodiment the pulp transportation chamber wall part 22 which is closest to the pulp distribution device 10 is a separate plate 37 pivoted on rods 38. Sealing may be provided by e.g. a transit plate, a seal between the pivoted plate 37 and the casing 18 and sealed lead-throughs for the rods 38.

The adjustment of the throttle gap width Wt may be made manually or automatically. If the adjustment is made automatically, then it is probably easiest to control the throttle gap width Wt on the pressure in the pulp distribution device 10. Another alternative is to control on the inlet ratio, i.e. the pulp volume flow into the pulp distribution device 10 divided with the pulp volume flow out from the pulp distribution device 10. The outlet pulp volume flow may be calculated as the rotational speed of the press roll 20 times the length of the press roll 20 times the throttle gap width Wt.

Yet other alternatives may be to control on pulp level or temperature in the pulp distribution device 10, on the vat pressure or on the pulp level in the ends of the press roll 20. Of course it is also possible to control on a combination of different parameters. It is, however, preferable to separate the pulp distribution device pressure control from the vat pressure control, since this enables to have a high pressure in the pulp distribution device 10 without necessitating having a high pressure in the vat 22.

The practical implementation of the automatic control may be to have one or more sensors (not shown) for the parameter measurement and/or calculation and to use e.g. one or more actuators, e.g. hydraulic, pneumatic and/or mechanic actuators, (not shown) for the throttle gap width adjustment, which actuator(s) is/are controlled by a controller (not shown). The controller may be stand-alone or integrated in a computer in a known manner, preferably as simple feedback control, but feed-forward control is also conceivable or a combination of both.

For the purpose of this disclosure, "longitudinal distribution of pulp" refers to distribution of pulp along/to the width of the pulp web formed on the first movable permeable surface. The pulp is thus distributed in a direction substantially transverse to the direction of movement of the movable first permeable surface. This means that the rotatable distribution means is arranged with its rotation axis substantially transverse to the direction of movement of the movable first permeable surface.

Accordingly, in a roll press application "longitudinal distribution of pulp" refers to distribution of pulp along/to the width of the pulp web formed on the press roll. The pulp is thus distributed in a direction substantially transverse to the rotational direction of the press roll. This means that the rotatable distribution means is arranged with its rotation axis substantially transverse to the rotational direction of the press roll. In a roll press application, longitudinal distribution of pulp consequently means lengthwise distribution of pulp, typically along the length of the press roll and along the length of the pulp distribution device.

Even though the description has been concentrated on an apparatus in the form of a twin roll press, the invention is by no means restricted to a twin roll press, but may be used in any apparatus where a pulp distribution device is distributing pulp on a first moving permeable surface. The first moving permeable surface needs thus not be rotatable, but may be moving in other ways and the apparatus may thus also be e.g. a twin wire press.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for washing and/or dewatering cellulose pulp comprising a first movable permeable surface traveling in a first direction, a pulp transportation chamber wall adjacent to said first movable permeable surface, sized to provide a pulp transportation chamber having a chamber gap between said pulp transportation chamber wall and said first movable permeable surface, a pulp distribution member comprising an inlet and an outlet arranged for distributing said pulp through said outlet onto said movable permeable surface, a moveable throttle adjacent to said outlet of said pulp distribution member in said first direction, said moveable throttle having a throttle gap width, a portion of said first movable permeable surface adjacent to said outlet of said pulp distribution member comprising a second permeable surface for initially dewatering said pulp moving in said first direction before said moveable throttle, said second permeable surface being sufficiently large so as to begin forming and dewatering said pulp before said moveable throttle, and an adjustable throttle member for remotely adjusting said throttle gap width, said throttle gap width being adapted whereby said pulp volume flow into said pulp distribution member is equal to or greater than said pulp volume flow out of said pulp distribution member during operation.

2. Apparatus according to claim 1 wherein said pulp distribution member includes web means for forming said pulp into a pulp web on said first movable permeable surface.

3. Apparatus according to claim 1 wherein said throttle gap width is adapted so that said pulp distribution member remains substantially full during operation.

4. Apparatus according to claim 1 wherein said throttle gap width is adapted so that an internal pressure is created inside said pulp distribution member during operation.

5. Apparatus according to claim 1 wherein said pulp transportation chamber wall includes said movable throttle for adjusting said throttle gap width.

6. Apparatus according to claim 5 wherein said movable throttle comprises at least one longitudinal segment.

7. Apparatus according to claim 5 wherein said movable throttle comprises a flexible or pivotable plate.

8. Apparatus according to claim 5 wherein said movable throttle includes a clearance after said movable throttle in said first direction.

9. Apparatus according to claim 5 including moving means for moving said movable throttle.

10. Apparatus according to claim 9 wherein said moving means is selected from the group consisting of at least one rod, at least one plate, and at least on eccentric puck disposed on a shaft.

11. Apparatus according to claim 1 including an exchangeable member for determining said throttle gap width.

12. Apparatus according to claim 11 wherein said exchangeable member comprises a predetermined number of shims.

13. Apparatus according to claim 1 including automatic control means for controlling said throttle gap width based upon at least one parameter.

14. Apparatus according to claim 13 wherein said at least one parameter is selected from the group consisting of the filling level of said pulp distribution member, the pressure in said pulp distribution member, the ratio between the pulp volume flow into said pulp distribution member, and the pulp volume flow out of said pulp distribution member, the temperature in said pulp distribution member, the pressure in said pulp distribution chamber, and the pulp level in the ends of said first permeable surface.

15. The apparatus according to claim 1 wherein said first movable permeable surface comprises a first rotatable permeable surface of a press roll.

* * * * *